US007037473B1

(12) United States Patent
Donner et al.

(10) Patent No.: US 7,037,473 B1
(45) Date of Patent: May 2, 2006

(54) DEVICE FOR GASIFYING COMBUSTIBLE MATERIALS, RESIDUES AND WASTE MATERIALS CONTAINING CARBON

(75) Inventors: Ralf Donner, Grimma (DE); Dietmar Degenkolb, Freiberg (DE); Manfred Schingnitz, Freiberg (DE)

(73) Assignee: Future Energy GmbH, Freiberg (DE)

( * ) Notice: Subject to any disclaimer, the term of this patent is extended or adjusted under 35 U.S.C. 154(b) by 0 days.

(21) Appl. No.: 09/486,784

(22) PCT Filed: Jul. 16, 1998

(86) PCT No.: PCT/DE98/01995

§ 371 (c)(1),
(2), (4) Date: Mar. 1, 2000

(87) PCT Pub. No.: WO00/01787

PCT Pub. Date: Jan. 13, 2000

(30) Foreign Application Priority Data

Jul. 1, 1998 (DE) ..... 198 29 385

(51) Int. Cl.
*B01J 3/00* (2006.01)

(52) U.S. Cl. ..... 422/242; 422/198; 422/203; 422/239; 422/241; 48/61; 48/67; 48/77; 48/84; 48/127.9

(58) Field of Classification Search ..... 48/61, 48/62 R, 77, 67, 197 R, 209, 210, 197 FM, 48/84, 127.9; 165/169, 189; 422/164, 184.1, 422/185, 198–203, 205, 240, 241, 239, 242
See application file for complete search history.

(56) References Cited

U.S. PATENT DOCUMENTS

| | | | | |
|---|---|---|---|---|
| 2,231,295 | A * | 2/1941 | Price | 165/51 |
| 4,188,915 | A * | 2/1980 | Kummel et al. | 122/6 A |
| 4,343,626 | A | 8/1982 | Peise et al. | |
| 5,667,758 | A * | 9/1997 | Matsugi et al. | 422/198 |
| 2001/0020346 | A1* | 9/2001 | Schingnitz et al. | 48/127.9 |
| 2002/0157312 | A1* | 10/2002 | Adler et al. | 48/197 FM |

FOREIGN PATENT DOCUMENTS

| | | | |
|---|---|---|---|
| DE | 3523610 | A * | 3/1986 |
| EP | 254 830 | | 2/1988 |
| FR | 2 569 827 | | 3/1986 |

* cited by examiner

*Primary Examiner*—Glenn Caldarola
*Assistant Examiner*—Vinit H. Patel
(74) *Attorney, Agent, or Firm*—Cohen, Pontani, Lieberman & Pavane

(57) ABSTRACT

An appliance for the gasification of carbon- and ash-containing fuel, residual and waste materials using an oxygen-containing oxidizing agent at temperatures above the melting point of the inorganic fractions, in a reaction chamber which is designed as an entrained-bed reactor, at pressures between atmospheric pressure and 80 bar, preferably between atmospheric pressure and 30 bar, the contour of the reaction chamber being delimited by a cooled reactor wall. The cooled reactor wall having the following structure, from the outside inward: a pressure shell, a cooling wall, a water-cooled gap between the pressure shell and the cooling wall, a ceramic protection for the cooling wall, and a layer of slag. The pressure and temperature of the cooling gap between the pressure shell and the cooling wall is controlled in such a way that it can be operated above and below the boiling point of the cooling water. The pressure in the cooling gap is higher than the pressure in the gasification chamber.

7 Claims, 2 Drawing Sheets

DEVICE FOR GASIFYING COMBUSTIBLE MATERIALS, RESIDUES AND WASTE MATERIALS CONTAINING CARBON

PRIORITY CLAIM

This is a U.S. national stage of application No. PCT/DE98/01995, filed on Jul. 16, 1998. Priority is claimed on that application and on the following application:

Country: Germany, Application No.: 198 29 385.2, filed: Jul. 1, 1998.

BACKGROUND OF THE INVENTION

1. Field of the Invention

The invention relates to an appliance for gasification of carbon-containing fuel, residual and waste materials.

2. Discussion of the Prior Art

Fuel and waste materials are to be understood as meaning those with or without an ash content, such as brown or hard coals and their cokes, water/coal suspensions, but also oils, tars and slurries, as well as residues or wastes from chemical and wood pulping processes, such as for example black liquor from the Kraft process, as well as solid and liquid fractions from the waste management and recycling industry, such as used oils, PCB-containing oils, plastic and domestic refuse fractions or their processing products, lightweight shredded material from the processing of automotive, cable and electronics scrap, and contaminated aqueous solutions and gases. The invention can be used not only for entrained-flow gasifiers, but also for other gasification systems, such as fixed-bed or fluidized-bed gasifiers or combinations thereof.

The autothermal entrained-flow gasification of solid, liquid and gaseous fuel materials has been known for many years in the field of gas generation. The ratio of fuel to oxygen-containing gasification agents is selected in such a way that, for reasons of quality of the synthesis gas, higher carbon compounds are cleaved completely to form synthesis-gas components, such as CO and $H_2$, and the inorganic constituents are discharged in the form of a molten liquid (J. Carl, P. Fritz, NOELL-KONVERSIONSVERFAHREN [NOELL CONVERSION PROCESS], E F-Verlag für Energie- und Umwelttechnik GmbH, Berlin, 1996, p. 33 and p. 73).

Using various systems which have gained acceptance in the prior art, gasification gas and the molten liquid inorganic fraction, e.g. slag, can be discharged from the reaction chamber of the gasification appliance separately or together (see German reference DE 19718131.7).

Both systems which are provided with a refractory lining or cooled systems have been introduced for internally delimiting the reaction chamber of the gasification system (see German reference DE 4446803 A1).

Gasification systems which are provided with a refractory lining have the advantage of low heat losses and therefore offer an energy-efficient conversion of the fuel materials supplied. However, they can only be used for ash-free fuel materials, since the liquid slag which flows off the inner surface of the reaction chamber during the entrained-flow gasification dissolves the refractory lining and therefore only allows very limited operating times to be achieved before an expensive refit is required.

In order to eliminate this drawback which is encountered with ash-containing fuel materials, cooled systems working on the principle of a diaphragm wall have therefore been provided. The cooling initially results in the formation of a solid layer of slag on the surface facing the reaction chamber, the thickness of which layer increases until the further slag ejected from the gasification chamber runs down this wall in liquid form and flows out of the reaction chamber, for example together with the gasification gas. Such systems are extremely robust and guarantee long operating times. A significant drawback of such systems consists in the fact that up to approx. 5% of the energy introduced is transferred to the cooled screen.

Various fuel and waste materials, such as for example heavy-metal- or light-ash-containing oils, tars or tar-oil solid slurries contain too little ash to form a sufficiently protective layer of slag with cold reactor walls, resulting in additional energy losses, yet on the other hand the ash content is too high to prevent the refractory layer from melting away or being dissolved if reactors with a refractory lining were to be used and to allow sufficiently long operating times to be achieved before a refit is required.

A further drawback is the complicated structure of the reactor wall, which may lead to considerable problems during production and in operation.

For example, the reactor wall of the entrained-flow gasifier shown in J. Carl, P. Fritz: NOELL-KONVERSIONSVERFAHREN [NOELL CONVERSION PROCESS], E F-Verlag für Energie- und Umwelttechnik GmbH, Berlin, 1996, p. 33 and p. 73 comprises an unpressurized water shell, the pressure shell, which is protected against corrosion on the inside by a tar/epoxy resin mixture and is lined with lightweight refractory concrete, and the cooling screen, which, in the same way as a diaphragm wall which is conventionally used in the construction of boilers, comprises cooling tubes which are welded together in a gastight manner, through which water flows, which are pinned and which are coated with a thin layer of SiC. Between the cooling screen and the pressure shell, which is lined with refractory concrete, there is a cooling-screen gap which has to be purged with a dry, oxygen-free gas in order to prevent flow-back and condensation.

SUMMARY OF THE INVENTION

Working on the basis of this prior art, the object of the invention is to provide an appliance which, while being simple and reliable to operate, is able to cope with a very wide range of ash contents in the fuel and waste materials.

The appliance according to the invention is suitable for the gasification of fuel, waste and residual materials with a very wide range of ash contents, and for the combined gasification of hydrocarbon-containing gases, liquids and solids.

According to the invention, the contour of the reaction chamber for the gasification process is delimited by a refractory lining or by a layer of solidified slag. If the reaction chamber is lined with refractory material, intensive cooling protects this material or causes liquid slag to solidify, so that a thermally insulating layer is formed. The cooling is provided by a water-filled cooling gap, it being possible to set operating conditions above or below the boiling point.

The invention will be explained in more detail on the basis of two exemplary embodiments.

The various features of novelty which characterize the invention are pointed out with particularity in the claims annexed to and forming part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
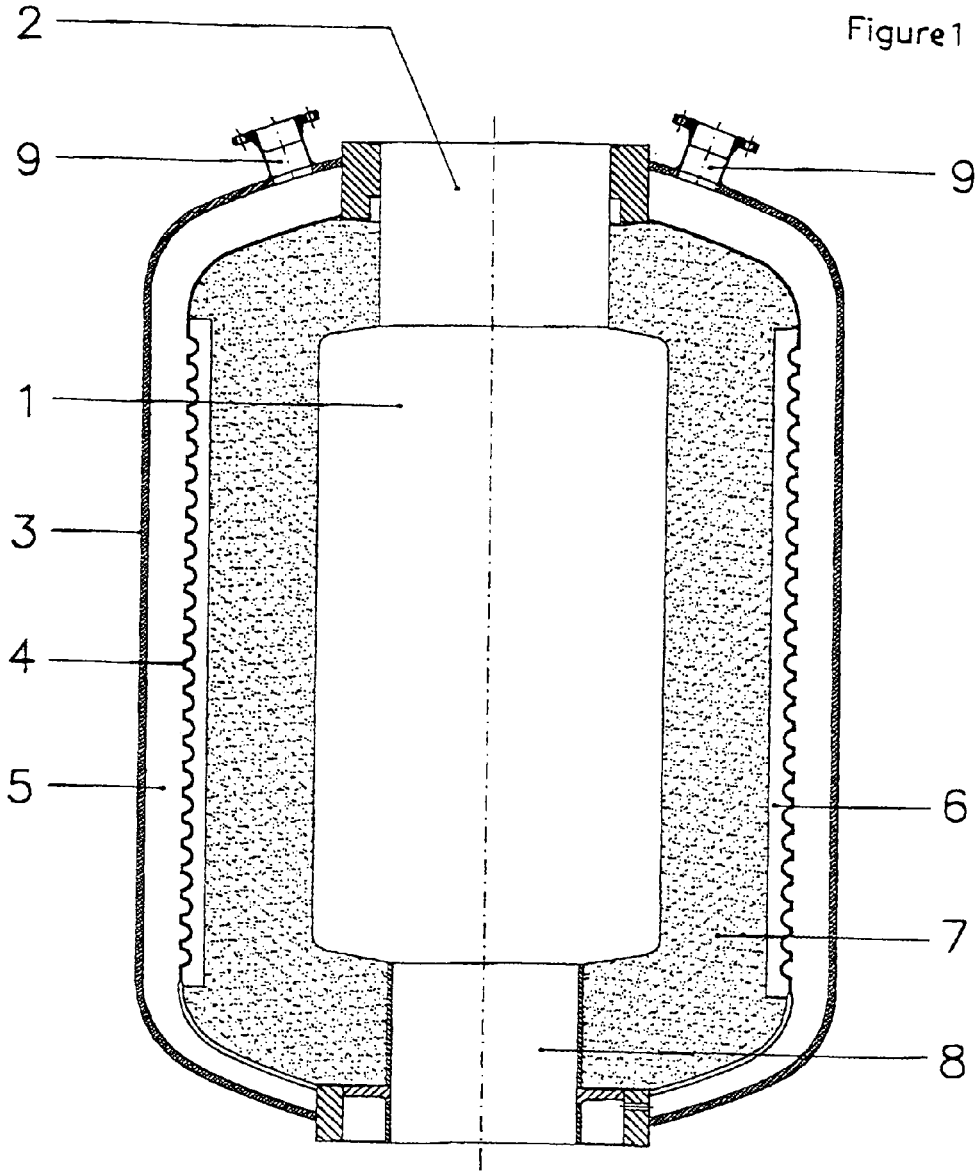
FIG. 1 shows a cross-section through a gasification reactor pursuant to the present invention.

In the first exemplary embodiment, FIG. 1 shows the gasification reactor. The conversion of the fuel, residual and waste materials using the oxygen-containing oxidizing agent to form a crude gas containing high levels of $H_2$ and CO takes place in the reaction chamber 1. The gasification media are supplied by means of special burners which are attached to the burner flange 2. The crude gasification gas, if appropriate together with liquid slag, leaves the reaction chamber 1 via the opening 8, which is provided with a special appliance, and passes to downstream cooling, scrubbing and processing systems. The gasification reactor is surrounded by the pressure shell 3, which absorbs the difference in pressure between the reaction chamber 1 and the outside atmosphere. For its thermal protection, there is a cooling gap 5 which, filled with water, can be operated above or below the boiling point, which depends on the overall pressure. To prevent gasification gas from entering the cooling gap 5 in the event of damage, the pressure of this gap 5 is always maintained at a higher level than the pressure in the reaction chamber 1. On the inside, the cooling gap 5 is delimited by a cooling wall 4. The hot water or steam generated in the cooling gap 5 is discharged via the connection piece 9. The cooling wall 4 may be provided with a thin, ceramic protective layer 6 which is fixedly bonded to the surface of the wall 4. Depending on the process pressure, the temperatures in the cooling gap 5 may be between 50 and 350° C. In the case of gasification of starting materials which contain very little or no ash, it is advantageous to line the cooling wall 4 with refractory, thermally insulating brickwork as a refractory lining 7 in order to limit the introduction of heat into the cooling gap 5. If ash-containing fuel, residual and waste materials are used, it is possible to dispense with the refractory brickwork 7. The liquid slag which forms in the reaction chamber 1 is cooled on the cold surface of the cooling wall 4 and its protective layer solidifies and in this way forms a refractory lining as a layer of slag which grows toward the reaction chamber 1 until the temperature has reached the melting point of the slag. The further slag which is then ejected runs off as a film of slag and is discharged together with the hot crude gas via the opening 8.

Figure 2:
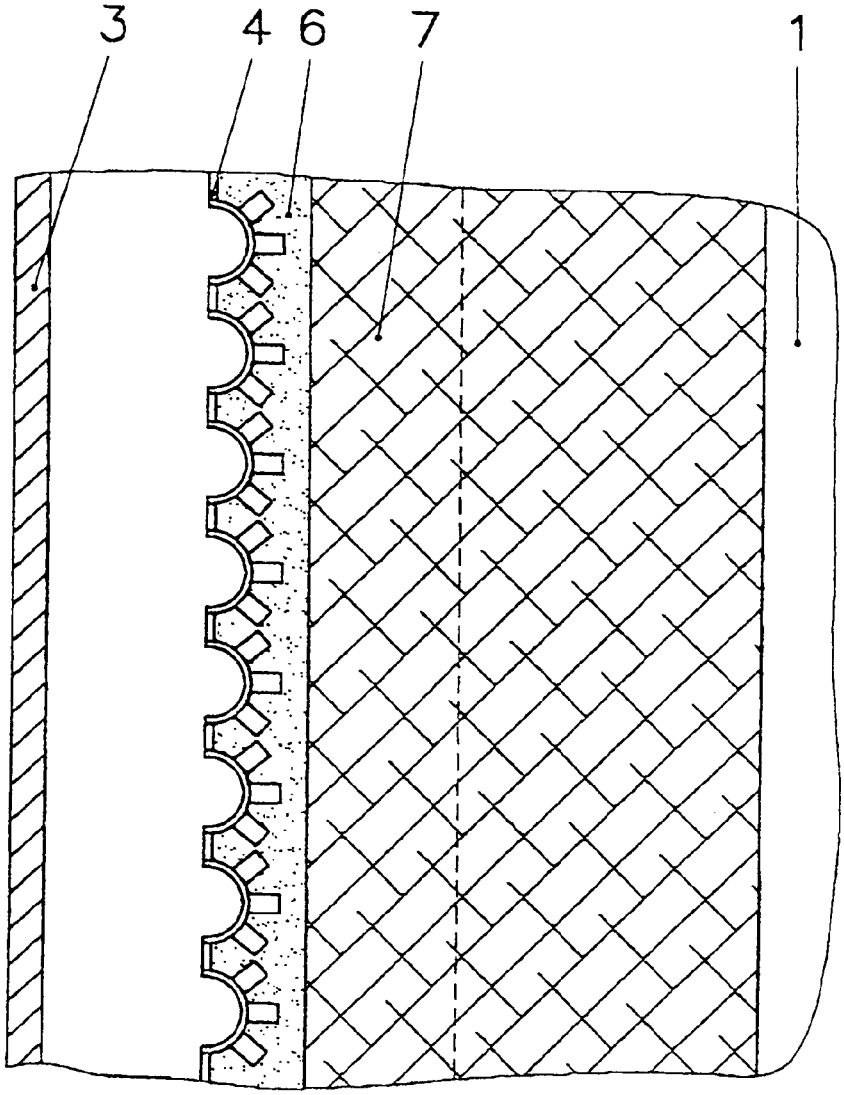
FIG. 2 shows an enlarged segment of the gasification reactor of FIG. 1.

FIG. 2 shows one example of the design of the cooling wall 4. In this case, this wall comprises a wall made from half-tubes which have been welded together in a gastight manner, are pinned and are combined with a thin layer of silicon carbide. The ceramic lining is situated on the side facing toward the reaction chamber 1, as a layer of slag which, as shown in Example 1, is applied artificially or forms naturally through its own molten ash. Other forms of the cooling wall, such as for example a wall made from corrugated sheet metal, in the shape of a trapezium, triangle or rectangle, are possible depending on the production techniques employed. The ceramic protection 6 may be applied and secured by mechanical holding means, as in Example 2, or by chemical bonding or thermal application, such as by flame spraying.

Furthermore, it will be readily understood that the design of the wall which delimits the reaction chamber 1, including parts 3, 4, 5, 6 and 7, which is explained in Example 2, can be used not only for the entrained-flow gasification reactors, which are subject to high thermal loads, but also for other gasification systems, such as for example fixed-bed or fluidized-bed gasifiers or combinations thereof.

The invention is not limited by the embodiments described above which are presented as examples only but can be modified in various ways within the scope of protection defined by the appended patent claims.

The invention claimed is:

1. An appliance for gasification of carbon-containing, ash-free fuel, residual and waste materials using an oxygen-containing oxidizing agent at temperatures above 850° C. and at pressures between atmospheric pressure and 80 bar, comprising a reaction chamber designed as an entrained-flow reactor having a contour delimited by a cooled reactor wall and having an inlet opening and an outlet opening, the cooled reactor wall having the following structure from the outside inward:

a pressure shell arranged and dimensioned for absorbing the pressure difference between the reactor chamber and the ambient pressure outside of the reactor wall;

a water-cooled cooling gap;

a cooling wall arranged inside of the pressure shell, the water-cooled cooling gap being defined by the pressure shell and the cooling wall, said cooling wall comprising a metal wall with a ceramic protection layer of ceramic mass having high thermal conductivity arranged on a side of the cooling wall facing away from the cooling gap, wherein said metal wall includes pins penetrating into said protection layer for mechanically holding said metal wall onto said protection layer; and a ceramic refractory lining on an internal surface of the cooling wall facing the reaction chamber such that said ceramic protection layer is arranged between said metal wall and said ceramic refractory lining, the cooling gap between the pressure shell and the cooling wall being operable, with a filling of pressurized water, such that pressure in the cooling gap is higher than pressure in the gasification chamber.

2. An appliance as defined in claim 1, wherein the metal wall of the cooling wall comprises half-tubes which are welded together in a gastight manner, are pinned and are coated with a thin layer of ceramic mass with a high thermal conductivity, the half-tubes being arranged on a side of the cooling wall facing the cooling gap.

3. An appliance as defined in claim 2, wherein the thin layer of ceramic mass is a flame-sprayed layer on the cooling wall.

4. An appliance as defined in claim 1, wherein the cooling wall has geometric shapes.

5. An appliance as defined in claim 1, wherein the metal wall of the cooling wall is of undulating form.

6. An appliance as defined in claim 1, wherein the pressure shell is connected to the cooling wall at the input opening and the outlet opening, wherein the protective layer facilitates cooling of the refractory lining.

7. An appliance as defined in claim 5, wherein the undulating form of the metal wall section is one of trapezium-shaped, triangular-shaped, and rectangular-shaped.

* * * * *